United States Patent [19]

McCloughan

[11] Patent Number: 4,457,441

[45] Date of Patent: Jul. 3, 1984

[54] TANK ASSEMBLY

[75] Inventor: Dexter C. McCloughan, Clark Lake, Mich.

[73] Assignee: Frigid Units, Inc., Toledo, Ohio

[21] Appl. No.: 393,650

[22] Filed: Jun. 30, 1982

[51] Int. Cl.[3] ..... B65D 6/02; B65D 6/10; B65D 6/34

[52] U.S. Cl. ..... 220/5 A; 119/3; 220/22; 220/69; 220/71; 220/73; 220/83; 220/415; 220/452; 220/457; 220/902; 220/DIG. 25

[58] Field of Search ..... 220/5 A, 71, 73, 453, 220/468, 452, DIG. 25, 83, 902, 457, 415, 69, 22; 119/3, 5, 15.5 R, 61; 428/316.6, 315.9; 137/571, 574, 576; 403/337, 205; 405/84, 81, 83, 45, 50, 118, 120, 121, 122, 125, 126

[56] References Cited

U.S. PATENT DOCUMENTS

| | | | |
|---|---|---|---|
| 6,157 | 12/1874 | Munzinger | 220/5 A |
| 334,160 | 1/1886 | Berger | 405/120 X |
| 1,949,984 | 3/1934 | Walker | 403/337 X |
| 1,954,646 | 4/1934 | Pratt | 220/22.3 |
| 2,537,219 | 1/1951 | Girton | 220/5 A |
| 2,703,109 | 3/1955 | Saville | 403/337 X |
| 2,980,972 | 4/1961 | Kloote et al. | 52/309.9 X |
| 2,999,041 | 9/1961 | Lappala | 428/316.6 X |
| 3,096,600 | 7/1963 | Gwyther | 405/81 X |
| 3,100,568 | 8/1963 | Harkins | 220/73 X |
| 3,328,975 | 7/1967 | Lundholm et al. | 210/335 X |
| 3,353,706 | 11/1967 | Godshalk | 220/73 |
| 3,442,418 | 5/1969 | Stromberg | 220/73 X |
| 3,508,405 | 4/1970 | Koch | 405/121 |
| 3,606,958 | 9/1971 | Coffman | 220/453 |
| 3,664,071 | 5/1972 | Gallagher | 405/119 X |
| 3,786,609 | 1/1974 | Difazio | 52/309.9 X |
| 3,884,186 | 5/1975 | Hickey | 119/3 |
| 3,904,524 | 9/1975 | Pelton et al. | 220/453 X |
| 4,117,804 | 10/1978 | Moore et al. | 119/1 |
| 4,154,355 | 5/1979 | Shackelford | 220/DIG. 25 |
| 4,244,486 | 1/1981 | Ewald, Jr. | 220/5 A |

*Primary Examiner*—Allan N. Shoap

*Attorney, Agent, or Firm*—Emch, Schaffer & Schaub

[57] ABSTRACT

A tank assembly normally used in laboratories is disclosed. The tank assembly is modular including one or more channel modules and a connector module positioned at each end. The connector modules are of different types including bend modules and end modules. Opposed sidewalls of the channel modules each include an outwardly extending flange member at the top of each sidewall. A reinforcing member is positioned within each of said flange members.

4 Claims, 12 Drawing Figures

FIG. 1
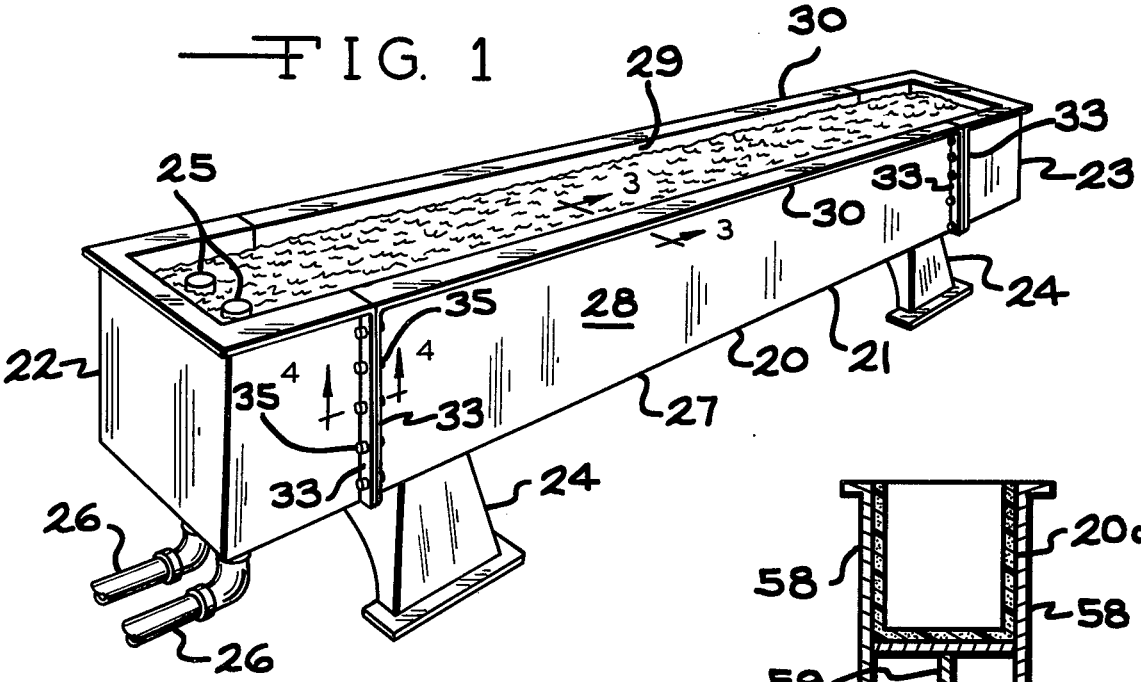
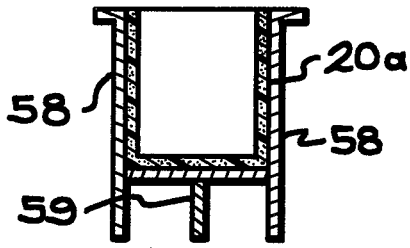
FIG. 2
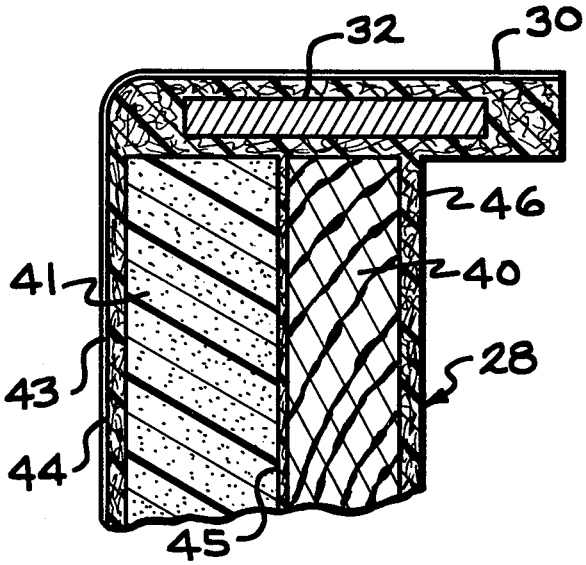
FIG. 3
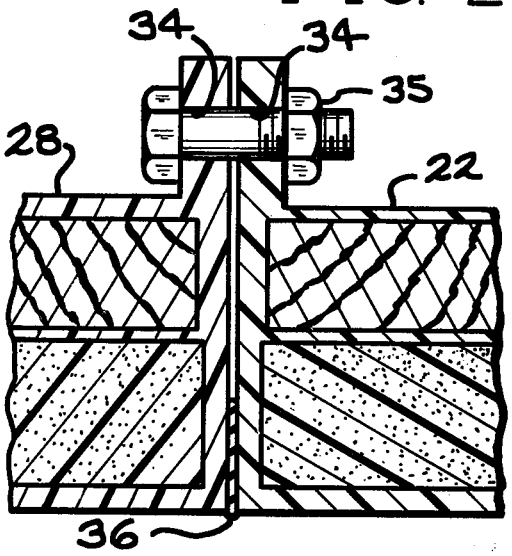
FIG. 4
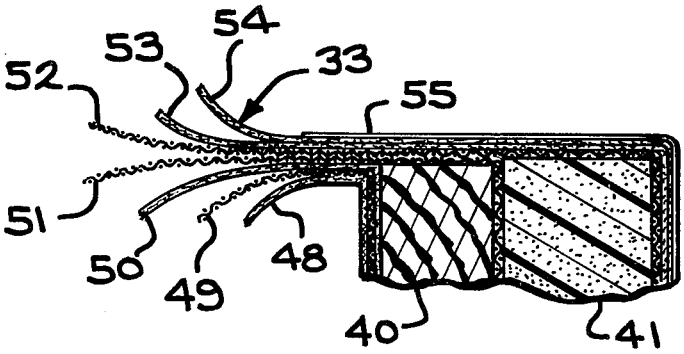
FIG. 5

TANK ASSEMBLY

BACKGROUND OF THE INVENTION

The present invention relates to an improved tank assembly which is normally used in a laboratory location. The tank assembly receives aquatic life such as fish. The tank assemblies are used in, for example toxicity studies, biological studies and carcinogenic studies.

Because of the delicate nature of the studies, there must be no contamination resulting from the tank assembly itself. This has presented a problem in prior art structures. For example, in a longitudinally extending unit as shown in FIGS. 6, 7 and 8 of the enclosed drawings, expansion perpendicular to the longitudinal axis of the straight runs must be limited. One prior art method of limiting side expansion in tanks was the use of metallic tie rods. However, it has been found that tie rods are not satisfactory in this type of tank, because of corrosion and other contamination problems. The present assignee has made and sold tanks more than one year prior to the date of this application which have configurations similar to those shown in the enclosed drawings, but which did not include a reinforcing member in the upper flange, similar to that shown in FIG. 3 of the present application drawings. It has been found that the present tank assembly, which includes the novel reinforcement, provides a structure which eliminates the need for intermediate tie rods and, therefore, may be used in scientific studies of aquatic life.

Another way of attempting to solve the lateral deflection problem of tanks is disclosed in U.S. Pat. No. 4,244,486. This patent discloses U-shaped strut members and exterior angle members along the upper edge of the tank.

It is the object of this invention to provide a tank assembly having improved lateral stability.

SUMMARY OF THE INVENTION

The invention provides an improved tank assembly for aquatic life. The tank assembly is modular and includes one or more channel modules, with a connector module positioned at each end. The connector modules are of different types. Bend modules are used for forming serpentine or elliptical tank layouts. End modules are used in non-continuous tank layouts.

The channel modules include opposed sidewalls. An integral outwardly extending flange member is located at the top of each of the opposed sidewalls. A reinforcing member is positioned within each of said flange members for restraining lateral expansion.

BRIEF DESCRIPTION OF THE DRAWINGS

FIG. 1 is a perspective view of a tank assembly, according to the present invention. The FIG. 1 embodiment includes a channel module and two end modules;

FIG. 2 is a cross-sectional view of another embodiment of a channel module for a tank assembly, according to the present invention;

FIG. 3 is a fragmentary, enlarged cross-sectional view taken along the lines 3—3 of FIG. 1;

FIG. 4 is a fragmentary, enlarged sectional view taken along the lines 4—4 of FIG. 1;

FIG. 5 is a fragmentary, partly exploded, view in cross section showing the multi-layered structure of a typical fastening flange;

DETAILED DESCRIPTION OF THE DRAWINGS

Figure 6:
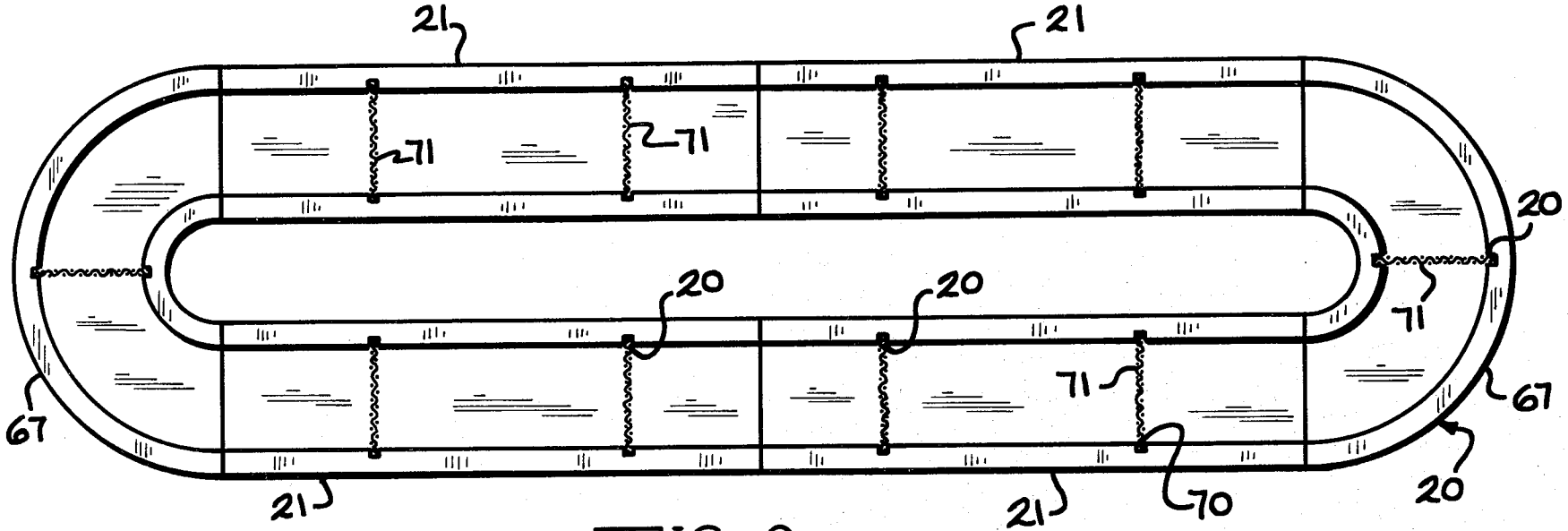
FIG. 6 is another layout of a tank assembly, according to the present invention, which includes several channel modules and two bend modules.

A tank assembly according to the present invention is generally indicated by the reference number 20. The tank assembly 20 includes a channel module 21 and a pair of connecting modules. In the FIG. 1 embodiment the connecting modules comprise end modules 22 and 23 fastened at opposed ends of the channel module 21.

The tank assembly 20, shown in FIG. 1 is supported by stands 24, which are known in the art. Stand pipes 25 are connected to drain lines 26.

The channel module 21 includes a bottom member 27 and integral side members 28 and 29, which extend upwardly from the bottom member 27. A flange member 30 is integrally formed with the sidewalls 28 and 29 and extends outwardly from the top of the opposed side members 28 and 29, as shown in FIGS. 1 and 3.

A reinforcing member 32 is positioned within the flange members 30 of the side members 28 and 29. In the present embodiment, the reinforcing member 32 comprises a metallic strip which is encapsulated and made an integral part of the flange member 30. It has been found that the encapsulated reinforcing member 32 in combination with the flange 30 and the side members 28 and 29 and the bottom member 27 provide an elongated structure suitable for aquatic life and aquatic studies which holds lateral deflection to a minimum without the use of contaminating tie rods or supplemental side supports.

Referring to FIGS. 1 and 4 the connecting modules, in this case the end modules 22 and 23, which are positioned at each of the longitudinally extending channel module 21 are connected to the channel modules by fastening means which includes fastening flanges 33 on the channel modules 21 and the end modules 22, 23. The fastening flanges 33 define openings 34 which receive stainless steel bolt and nut assemblies 35. As shown in FIG. 4, a seal strip is positioned on the water side of the assembly 20 between the abutting channel module 21 and end modules 22, 23. Referring to FIGS. 3 and 4, the modules, according to the present invention and specifically the channel module 21 are composed of multiple layers including a wood, for example a plywood layer 40 located on the exterior of the tank and an inner insulation layer 41 located on the interior of the tank. The layer 41 may be, for example, a polyurethane foam.

As best shown in FIG. 3, the entire sidewall member 28 consists of an inner gel coat layer 43, comprising a polyester gel coat, such as manufactured by Ferro Corporation; a fiberous glass layer 44; the foam insulation layer 41; a fiberous glass layer 45; the wood layer 40;

and a fiberous glass layer 46. The fiberous glass layers 44, 45 and 46 are normally constructed of well known fiberous glass mat and resin layups.

Referring to FIG. 5, a multi-layered structure is also utilized in the construction of the fastening flange members 33. The fastening flange 33 shown in FIG. 5 is comprised of a multi-layered fiberous glass layup, including a fiberous glass mat layer 48; a fiberous glass roving layer 49; a fiberous glass mat layer 50; a roving layer 51; a roving layer 52; a mat layer 53; a mat layer 54; and a gel coat layer 55. This entire multi layered structure is bound together in a resin layup, as is known in the art, and provides both a strong structure and also an inert, non-corrosive tank.

FIG. 2 of the application drawings shows a slightly different structure in which wooden side members 58 and a center wooden member 59 of a tank assembly 20*a* extend downwardly and serve as ground supports in lieu of the stands 24, shown in the FIG. 1 embodiment.

Figure 9:
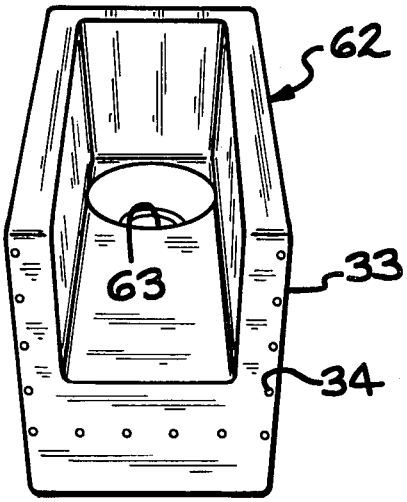
FIG. 9 is a perspective view of a collection box end module.
Figure 10:
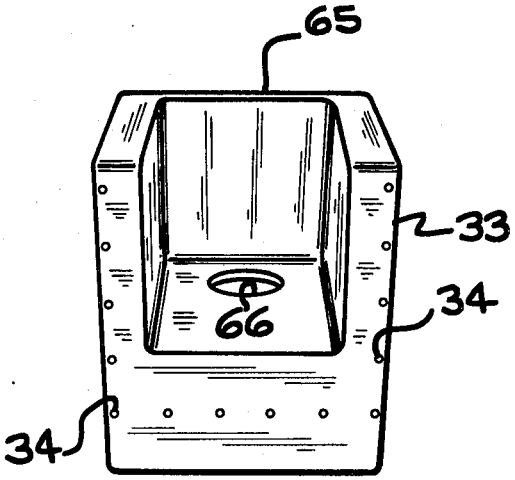
FIG. 10 is a perspective view of a header box end module.
Figure 11:
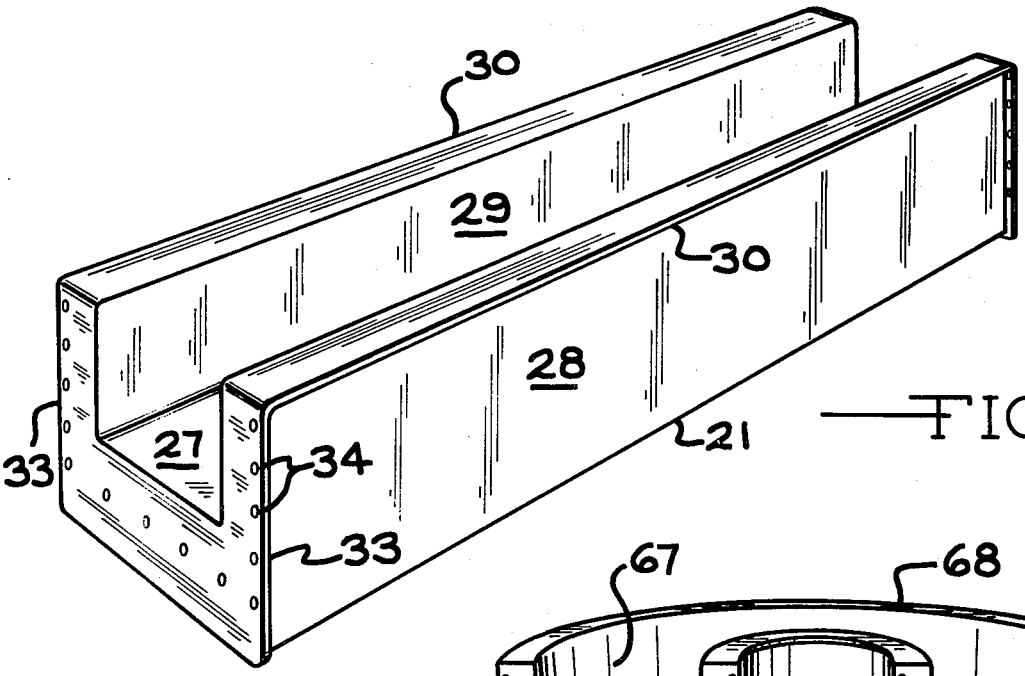
FIG. 11 is a perspective view of a channel module.
Figure 12:
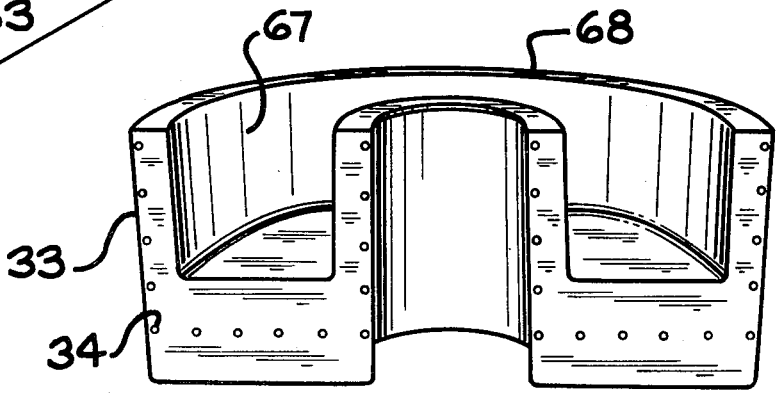
FIG. 12 is a perspective view of a bend module.

Referring to FIGS. 9, 10, 11 and 12, a perspective view of the channel module 21 is shown in FIG. 11 and three variations of connector modules are shown in FIGS. 9, 10 and 12. FIG. 9 discloses a collector box end module 62, which includes a recess waste opening 63 to collect the feces of the laboratory fish. FIG. 10 discloses a header box end module 65, which includes a drain opening 66.

Figure 7:
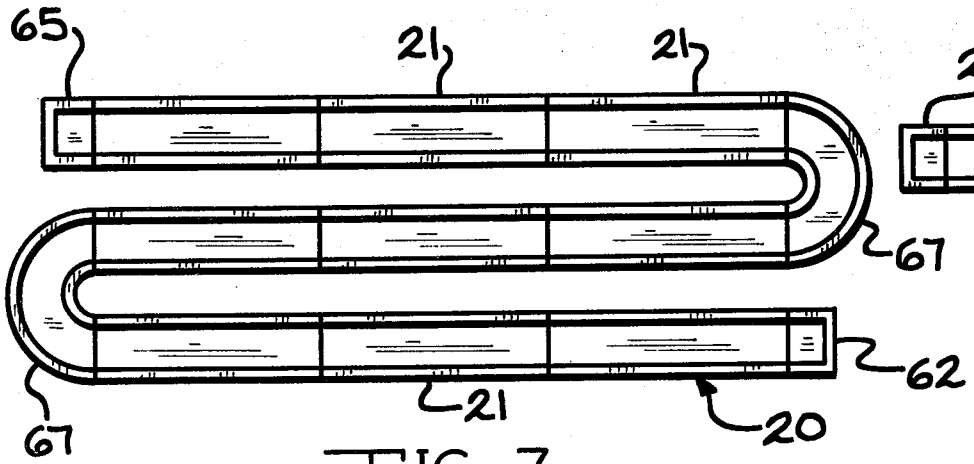
FIG. 7 is another layout of a tank assembly according to the present invention including several channel modules, a pair of bend modules and a pair of end modules.

FIG. 12 discloses a bend module 68 which defines a 180° channel 67 for use in serpintine layouts and elliptical layouts as shown in FIGS. 6 and 7.

Figure 8:
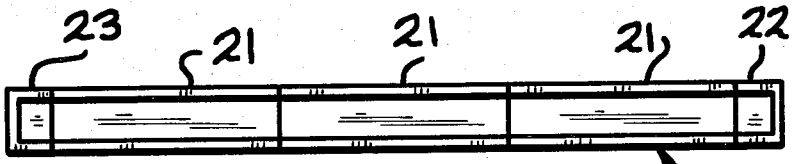
FIG. 8 is another layout of a tank assembly according to the present invention including three channel modules and a pair of end modules.

Referring to FIGS. 6, 7 and 8, various types of layouts are shown. FIG. 6 shows an elliptical layout comprising a plurality of channel modules 21 and a pair of bend modules 67. In this embodiment the channel modules 21 and the bend modules 67 define recess slots 70 which receive screens 71. The screens 71 segregate various areas of the overall tank assembly 20 from one another. Individual laboratory specimens may be positioned within the individual segregated areas.

FIG. 8 shows a tank assembly 20 including three channel modules 21 and end modules 22 and 23.

FIG. 7 shows a tank assembly 20 including a plurality of channel modules 21; a pair of bend modules 67; a header box end module 65; and a collector box end module 62.

It has been found that a tank assembly 20, according to the present invention, with the reinforcing means in the top flange of the channel module forming an important part of the combination, provides a tank assembly with limited lateral deflection allowing an overall superior and non-corrosive unit.

It would be appreciated from the above description of the preferred embodiments of the tank assembly that various changes and modifications may be made without departing from the spirit and scope of the following claims.

What I claim is:

1. A tank assembly comprising at least one longitudinally extending channel module, said channel module including a bottom member and opposed side members extending upwardly from said bottom member, said bottom members and said opposed side members comprise multiple layers, said multiple layers substantially comprising an inner gel coat layer, a fibrous glass layer, an inward foamed insulation layer, an intermediate fibrous glass layer, an outward layer of wood and an outer fibrous glass layer;

a flange member extending outwardly from the top of said opposed side members, said flange member being substantially comprised of said outer gel layer and said fibrous glass layer;

a reinforcing member positioned within each of said flange members, said reinforcing member substantially comprising a metal strip encapsulated within said flange members, said reinforcing member being in a spaced apart relationship with said foamed insulation layer and said wood layer;

a connecting module positioned at the end of said longitudinally extending channel module, said connecting module including a bottom member and opposed side members extending upwardly from said bottom members, said side members being substantially parallel; and, a fastening means for removeably connecting said channel module to said connector modules, said fastening means comprising fastening flanges on the ends of said channel module and said connector modules, and bolt assemblies for connecting abutting fastening flanges.

2. A tank assembly, according to claim 1, wherein said connector modules comprise end modules, said end modules including a bottom member and opposed side members extending upwardly from said bottom member, said side members being substantially parallel, said end modules further including a third side member, said third side member being positioned substantially perpendicular to said opposed side members and said bottom member.

3. A tank assembly, according to claim 1, wherein said connector modules comprise at least one bend module, said bend module including a bottom member and opposed side members extending upwardly from said bottom member, said side members defining a substantially 180° channel.

4. A tank assembly, according to claim 1, including screens positioned within said channel module to segregate areas of said tank assembly from one another.

* * * * *